United States Patent [19]

Lamb et al.

[11] 3,991,484

[45] Nov. 16, 1976

[54] MACHINE FOR DRYING PRINTED MATTER BY ULTRAVIOLET RADIATION

[75] Inventors: John K. Lamb; Edward H. Jones, both of Cincinnati, Ohio

[73] Assignee: Cincinnati Printing and Drying Systems, Inc., Cincinnati, Ohio

[22] Filed: Oct. 10, 1974

[21] Appl. No.: 513,540

[52] U.S. Cl. ..... 34/162; 34/4

[51] Int. Cl.[2] ..... F26B 13/02

[58] Field of Search ..... 34/4, 41, 162; 250/433, 250/527; 427/54; 118/642, 64

[56] References Cited

UNITED STATES PATENTS

| | | | |
|---|---|---|---|
| 3,052,037 | 9/1962 | Miskella | 34/41 |
| 3,151,950 | 10/1964 | Newman et al. | 34/41 |
| 3,829,982 | 8/1974 | Pray et al. | 34/4 |

*Primary Examiner*—Howard S. Williams
*Attorney, Agent, or Firm*—James W. Pearce; Roy F. Schaeperklaus

[57] ABSTRACT

A machine that receives freshly printed matter, and moves the printed matter on a belt along the machine so that the printed matter passes through an irradiation chamber where it is irradiated with ultraviolet light. The printed matter continues to move along the belt and is thereby removed from the irradiation chamber and delivered to the output end of the machine. The irradiation chamber is so constructed so as to control the intensity of the ultraviolet radiation that is delivered to the printed matter. Air moving means are also provided by which to control the maximum temperatures induced in the printed matter as it passes through the irradiation chamber. Another air moving means is employed to control the temperature of a radiator assembly employed within the irradiation chamber. A third air moving means is provided to evacuate the irradiation chamber and associated components of hot and contaminated air and to exhaust this air to the outside.

10 Claims, 17 Drawing Figures

FIG. 4B
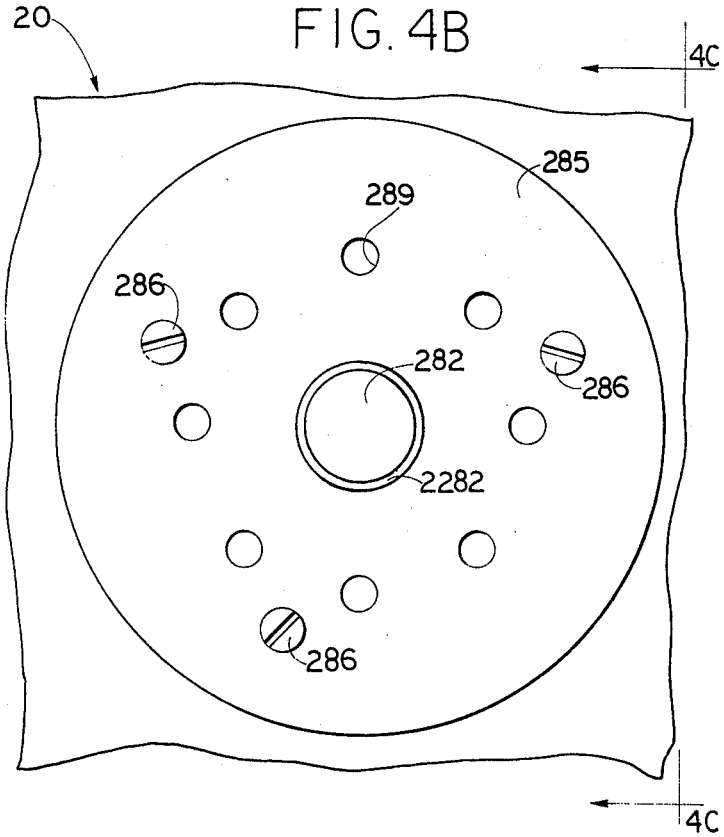
FIG. 4C
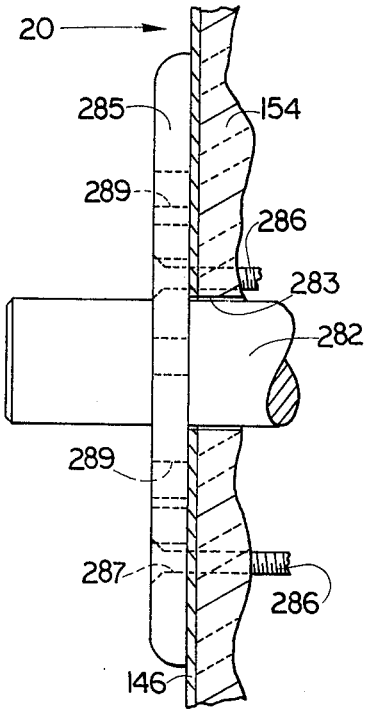
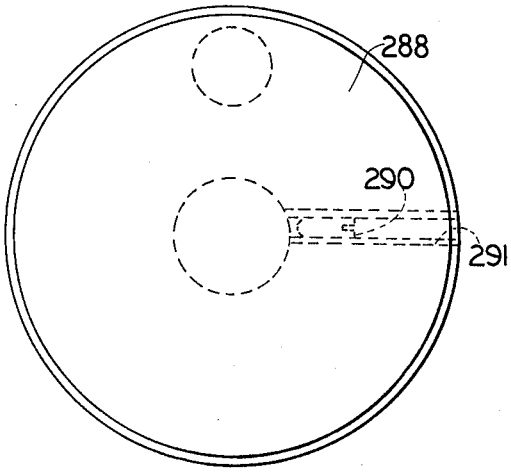
FIG. 4D
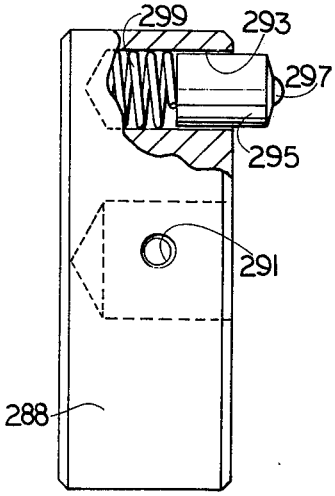
FIG. 4E

FIG. 5
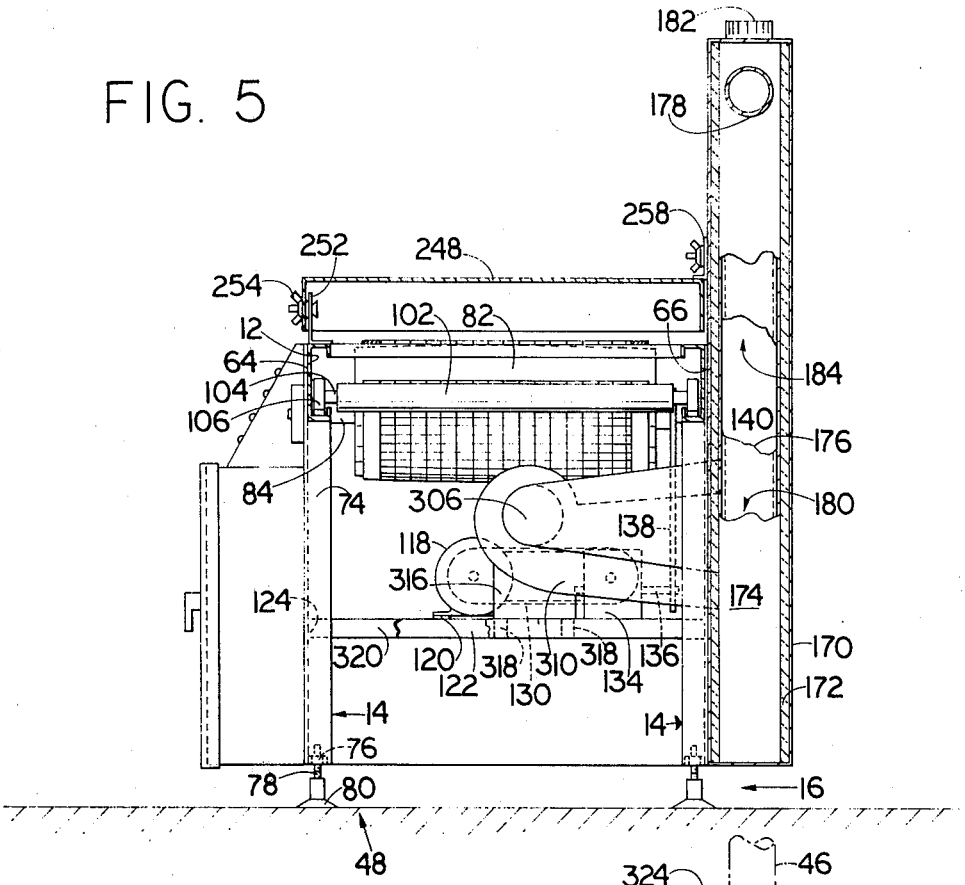
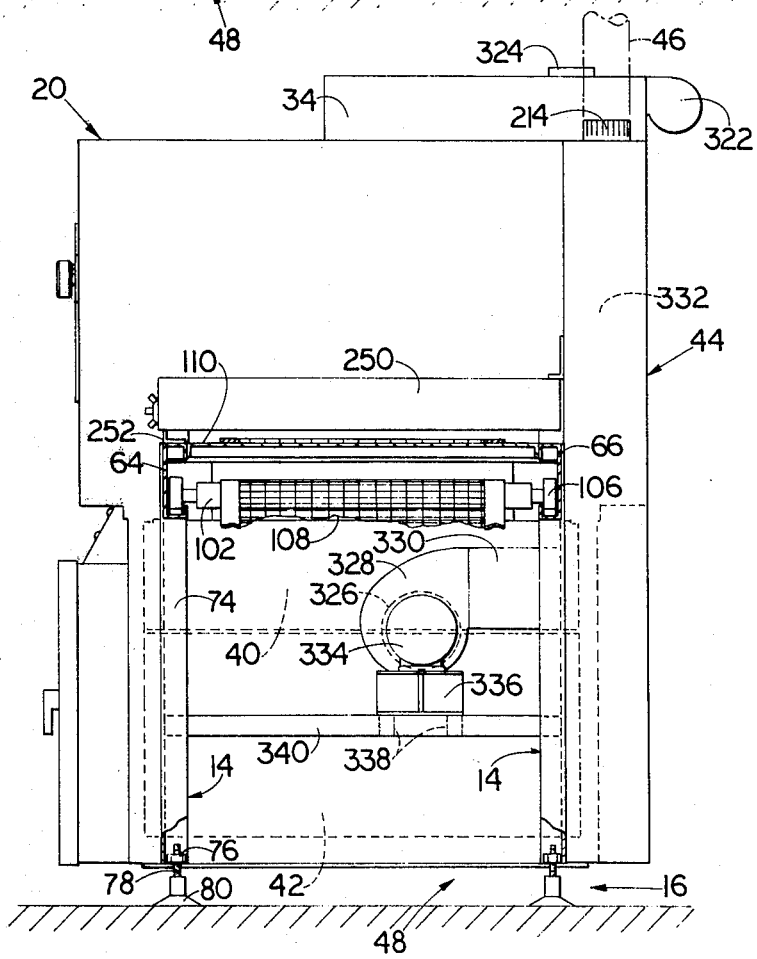
FIG. 6

MACHINE FOR DRYING PRINTED MATTER BY ULTRAVIOLET RADIATION

This invention relates to machines for quick drying freshly printed articles by means of ultraviolet radiation.

An object of this invention is to provide a machine that possesses a range of constant radiation intensities as received by the freshly printed matter moving through the machine.

Another object of this invention provides a machine that possesses a range of non-constant radiation intensities as received by the freshly printed matter moving through the machine.

A further object of this invention is to provide means for controlling the maximum temperature of the irradiated objects by means of an air impingement system located at an intermediate stage within the radiation process to prevent scorching or deformation (curl) of the irradiated objects passing through the machine.

A further object of this invention is to provide a machine possessing a variable speed conveyor system to cooperate with various drying speeds or rates that are required by different kinds of ink.

Another object of this invention is to provide a means of holding the irradiated objects on the conveyor system by means of a pressurized air stream in a vacuum suction system that pulls air down through porous belt, thereby holding the irradiated objects flat upon the conveyor belt.

Briefly, this invention provides a machine comprising a basic framework upon which a card transport assembly or conveyor belt system is mounted. The card transport assembly moves freshly printed cards or the like from an input position, along the machine and into a radiation chamber where the freshly printed matter or objects are irradiated with ultraviolet light, and are then moved at a given rate upon the card transport assembly to an output section of the machine. The articles transported can be of paper, cardboard, metal, plastic, and the like and can carry ultraviolet curable materials placed thereon by screen printing or by other methods of coating, printing, and decorating. The ultraviolet radiation received in the irradiation process can act in a chemical drying process whereby the freshly printed material becomes dry and fixed. The machine also incorporates a cooling system to control the heat buildup produced by the ultraviolet radiation source. As the irradiated material moves beneath a radiation assembly, a stream of cool air is directed vertically downward against the radiated objects to control their maximum temperature and to physically hold them flat against a porous transport belt of the card transport assembly. The radiation assembly is mounted for raising and lowering to control tne amount of radiation and can be tilted to provide varying or non-consistant radiation as the printed articles advance through the radiation chamber. A vacuum air system is located directly beneath the irradiation portion of the machine as well as beneath the card transport belt. This vacuum air collection system sucks cooling air down around irradiated objects and through the belt, thereby providing a physical restraint preventing the irradiated objects from deforming due to non-constant temperature gradients through their thicknesses. Blower and duct systems are incorporated within the machine to remove hot and contaminated air produced within the machine and to deliver such air to the outside ambient environment.

The above and other objects and features of the invention will be apparent to those skilled in the art to which this invention relates from the following detailed description and drawings in which:

FIG. 4B is a fragmentary view on an enlarged scale looking in the direction of the arrows 4B—4B in FIg. 4 with an adjusting and locking knob removed;

FIG. 4C is a view in section taken on line 4C-4C in FIG. 4B;

FIG. 4D is a view in front elevation of the adjusting and locking knob;

FIG. 4E is a view in side elevation of the adjusting and locking knob partly broken away to show details of a locking latch;

FIG. 5 is a sectional view taken along a line 5—5 as shown in FIG. 3, portions of a vertical duct assembly shown on the right side of FIG. 5 being cut away to expose internal parts;

FIG. 6 is a sectional view taken along a line 6—6 in FIG. 3, portions of the structure being cut away to expose the attachment of legs to the main frame of the ultraviolet dryer;

In the following detailed description and the drawings, like reference characters indicate like parts.

GENERAL DESCRIPTION OF FRAMES

Figure 1:
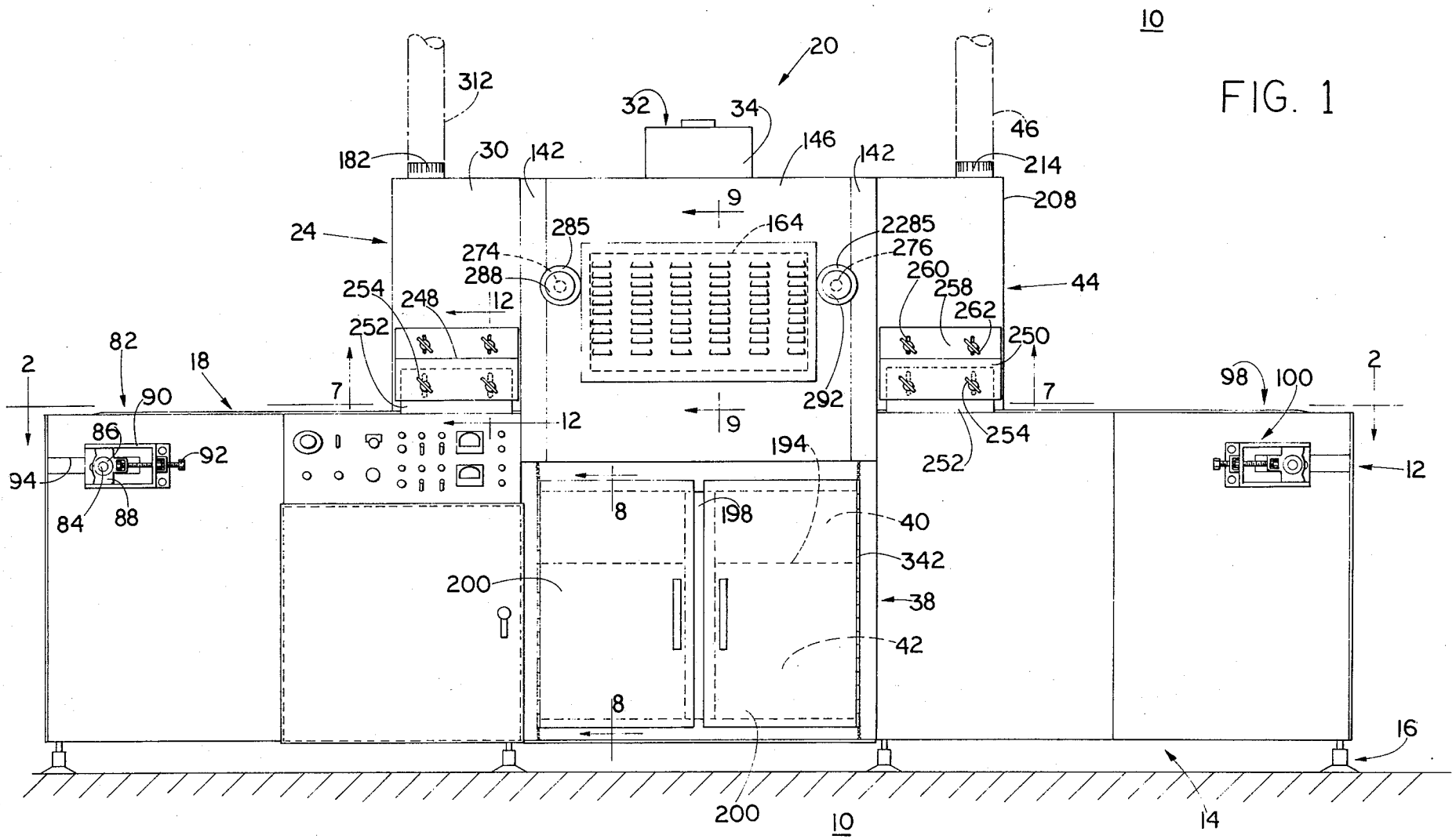
FIG. 1 is a view in front elevation of an ultraviolet dryer machine constructed in accordance with an embodiment of this invention, exhaust stacks being shown in dot-dash lines.

In FIG. 1 is shown an ultraviolet dryer 10 which is constructed in accordance with an embodiment of this invention.

Orientation terms to be used hereinafter are defined herein. As shown in FIG. 1 the left side of the figure will be hereinafter referred to as the input end of the ultraviolet dryer 10, and the right side of the figure will be hereinafter referred to as the output end of the ultraviolet dryer 10. Any horizontal line extending between the input and the output end of the ultraviolet dryer 10 will be referred to as the longitudinal direction. Any line lying in a horizontal plane and perpendicular to any longitudinal line will be hereinafter referred to as the lateral direction. With respect to the ultraviolet dryer 10, the word "front" will refer to that side of the machine generally shown in detail in FIG. 1. Similarly, the "back" of the machine is that side opposed to the front of the machine as shown in the figure.

Figure 2:
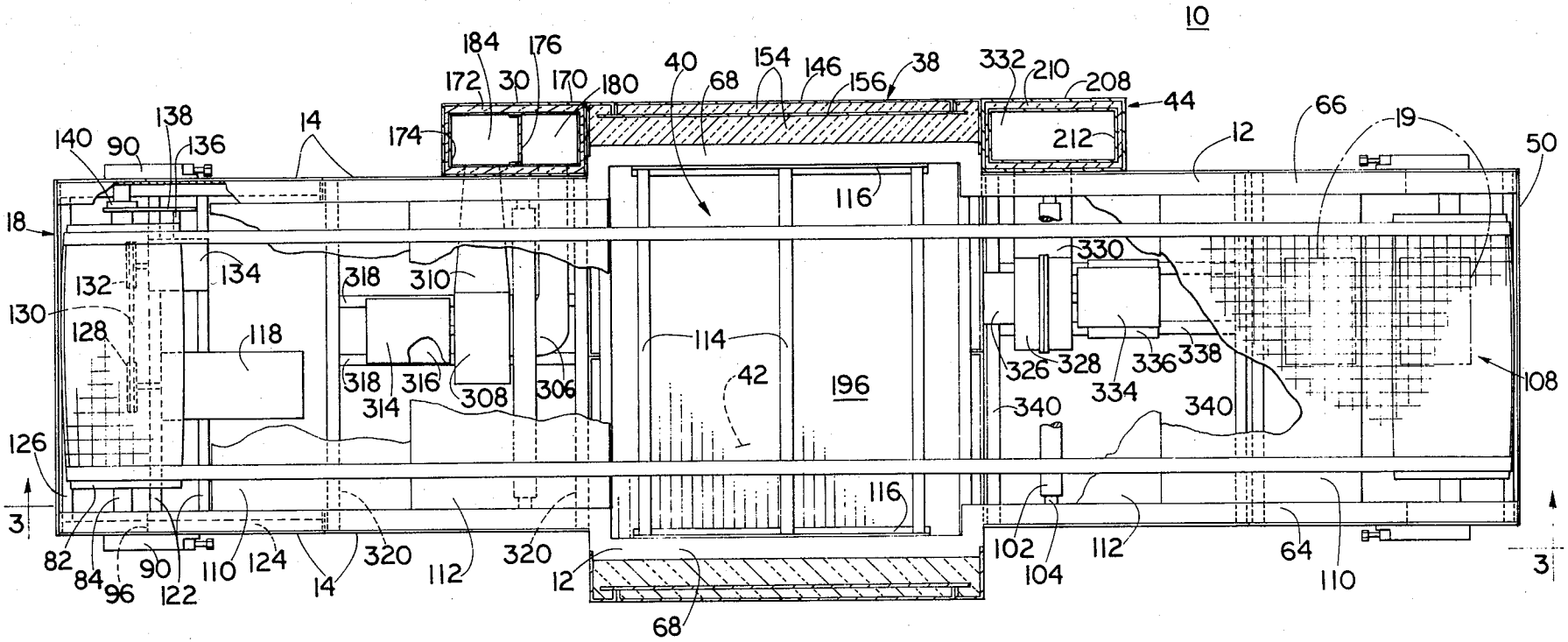
FIG. 2 is a view of the ultraviolet dryer machine, taken in section along a line 2—2 as shown in FIG. 1, top panels of the machine being cut away to expose machinery, printed articles passing through the machine being shown in dot-dash lines.
Figure 3:
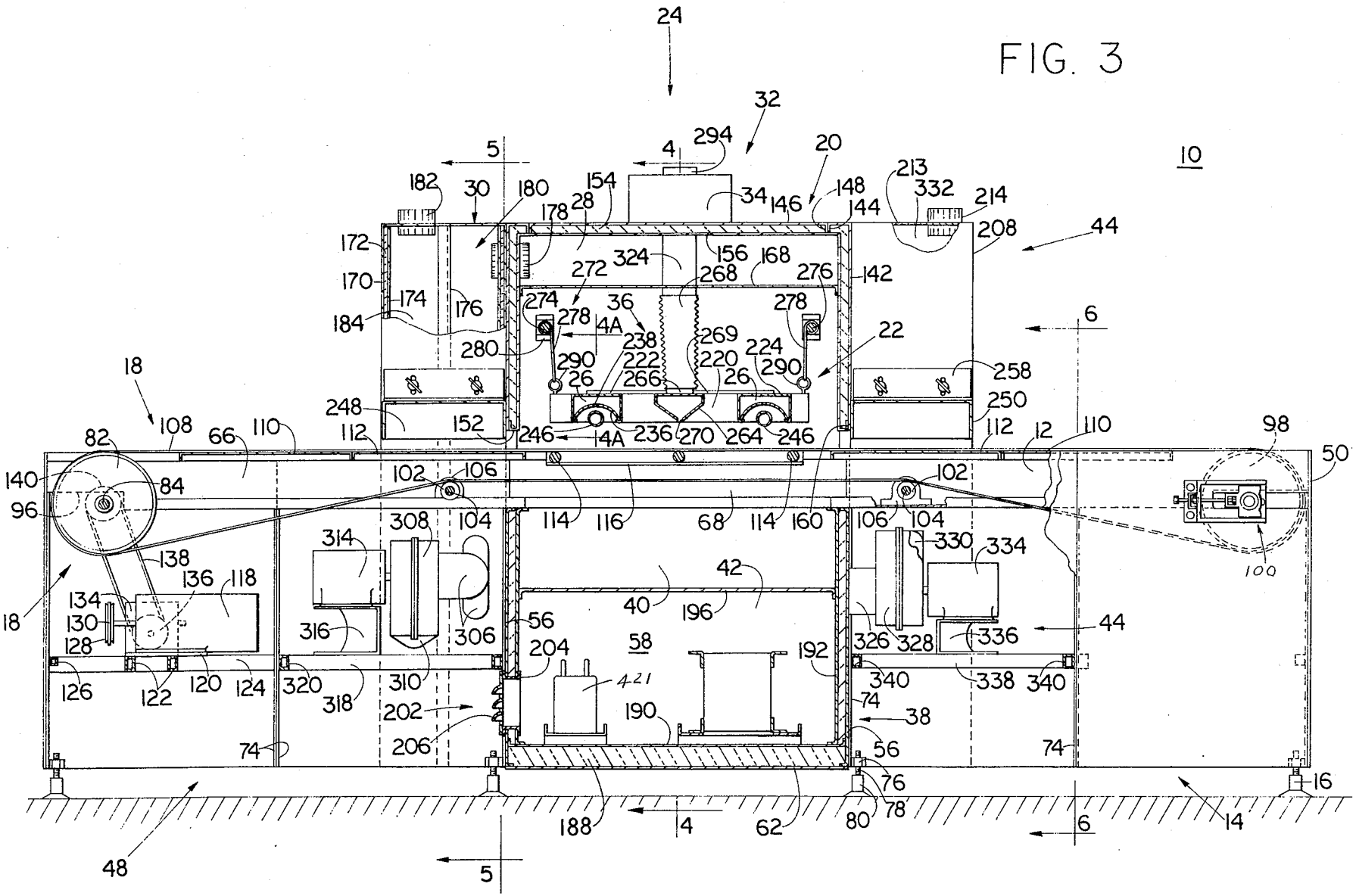
FIG. 3 is a sectional view in side elevation of the ultraviolet dryer machine, taken generally on the line 3—3 in FIG. 2.

The ultraviolet dryer 10 is comprised of a main frame assembly 12, shown in greater detail in FIGS. 2 and 3, that is held in vertical spaced relationship by a set of eight side panels 14 that are fixedly attached to the main frame assembly 12 along their upper edges, and a set of eight legs 16 fixedly attached to the bottoms of the set of eight side panels 14. The main frame assembly 12 incorporates a card transport assembly 18 that receives recently printed material such as printed cards 19 (FIG. 2) at its input end and moves it to the output end of the ultraviolet dryer 10 at any desired rate. An irradiation chamber 20 (FIG. 3) is centerly located longitudinally and laterally of the ultraviolet dryer 10 and above the card transport assembly 18. The irradiation chamber 20 incorporates an ultraviolet radiator assembly 22, as shown in FIG. 3. The ultraviolet radiator assembly 22 provides ultraviolet radiation that causes a chemical reaction that dries the ink on freshly printed material as it moves along the card transport assembly 18. Included within and adjacent to the irradiation chamber 20 is a radiator cooling system 24 that comprises radiator cooling duct assemblies 26, a top plenum 28, and a radiator exhaust duct assembly 30, as shown in FIG. 3. A card cooling assembly 32, as shown in FIGS. 1 and 3, incorporates a top lateral plenum 34 and a card cooling duct assembly 36 as shown more specifically in FIG. 3. The card cooling duct assembly 36 provides a lateral curtain of air that is forcefully blown down over the printed matter that moves along the card transport system 18. This lateral curtain of air reduces and controls the temperature of the irradiated material as it passes through irradiation chamber 20 to prevent scorching or excessive curling along the edges of the freshly printed matter. A collector box assembly 38 located beneath the irradiation chamber 20 includes a collector plenum or box 40, an accessory cabinet 42 and a collector box exhaust system 44. The collector box assembly 38 provides a low pressure air collecting assembly that removes air from the vicinity of the irradiation chamber 20 and draws it into the collector box exhaust system 44. The collector box exhaust system 44 then forcefully discharges the contaminated air to the outside ambient atmosphere through an outside collector box exhaust stack 46, as shown in FIG. 1. Contaminated air as referred to herein is hot air containing ozone and volatile gasses from the drying process.

Figures 4, 4A:
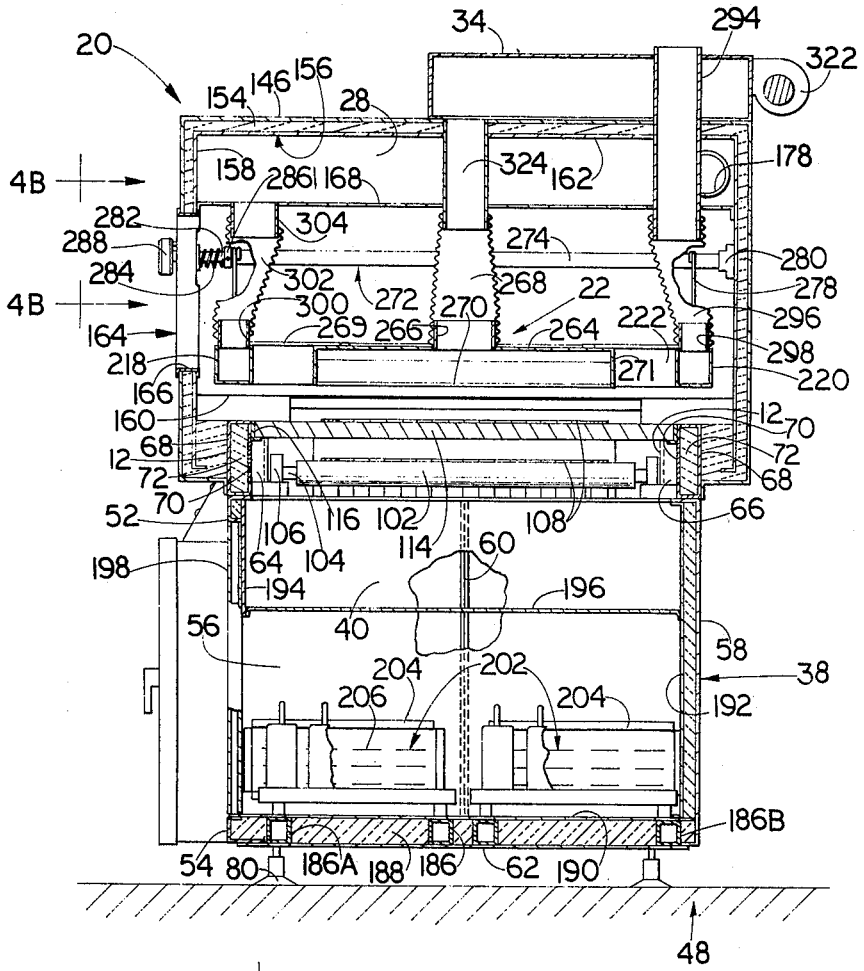
FIG. 4 is a sectional view taken on the line 4—4 as shown in FIG. 3 parts of the cooling air system being cut away to expose an adjusting means of the radiation assembly.
FIG. 4A is a fragmentary view in section on an enlarged scale taken on the line 4A—4A in FIG. 3.

A basic support structure assembly 48, shown in FIGS. 3 and 4, incorporates the collector box assembly 38, the main frame assembly 12 as shown in FIG. 2, the set of eight side panels 14 that are shown in FIGS. 2 and 3, and a pair of end panels 50 as shown. The collector box assembly 38 is comprised of a collector box top sill 52 (FIG. 4) and a collector box bottom ledge 54. A pair of collector box side panels 56 are rigidly affixed between the collector box top sill 52 and the collector box bottom ledge 54 to provide vertical spaced relationship therebetween. This assembly of parts forms the front half of the collector assembly 38. The collector box back panel 58 is of one-piece construction that includes the back of the collector box and also the remaining side panels to complete the full collector box assembly 38. The collector box back panel 58 is rigidly affixed to the front half of the collector box assembly 38 by means of flanges 60, as shown in FIG. 4. A collector box bottom 62 is rigidly affixed to the bottom of the previously described assembly.

The main frame assembly 12 (FIG. 2) includes a front channel beam 64 and a rear channel beam 66, each interrupted at its center by an offset center section 68. The offset center sections 68 are closed with a pair of filler panels 70 (FIG. 4). The internal volume of the offset center sections 68 is insulated with heat insulating material 72, such as mineral wool felt or some other appropriate material. Each panel of the set of eight side panels 14 (FIG. 3) is a flat panel of metal that incorporates side flanges 74 (FIGS. 5 and 6). The side flanges 74 are recessed from the top edge of each of the set of eight side panels 14 to cooperate in fitting around the channel beams 64 and 66 of the main frame 12 to which each is rigidly affixed. Each panel of the set of eight side panels is rigidly affixed to its neighboring panel by means of the side flanges 74. A set of eight legs 16 attached to the flanges 74 support the dryer 10. Each leg of the set of legs 16 incorporates a nut 76 (FIGS. 3 and 6), a bolt 78, and a suction cup foot 80 mounted on the bolt 78. As can be seen in FIG. 3, the legs 16 are spaced longitudinally along the ultraviolet dryer 10 on both the front and back sides of the machine. Each nut 76 is rigidly affixed at the intersection of a side flange 74 and the inside surface of its respective side panel 14. The bolt 78 is rotatably mounted in the nut 76 to provide individual vertical adjustment for each leg 16. The suction cup foot 80 is fixedly attached to the lower extremity of the bolt 78 and rotates therewith. The basic support structure assembly 48 is completed by the pair of end panels 50 (FIGS. 2 and 3). The pair of end panels 50 are fixedly attached to the side flanges of the side panels that are approximate to the input and output ends of the ultraviolet dryer 10. The pair of end panels 50 close end portions of the ultraviolet dryer 10, as well as provide lateral support.

The card transport assembly 18, as shown in FIGS. 1 and 3, includes an input drive roller 82 (FIG. 3) that is rigidly affixed to a drive axle 84. The drive axle 84 is rotatably held in a pair of bearings 86, one of which is shown in FIG. 1. Each of the bearings 86 is fixedly held in a bearing slide block 88, each of which in turn is slidably mounted in one of a pair of bearing slide block housings 90 (FIG. 2). The pair of bearing slide block housings 90 are fixedly attached on the outside surface of the appropriate pair of side panels 14. As can be seen in FIG. 1, each of the pair of bearing slide blocks 88 is longitudinally adjusted within the associated bearing slide block housing 90 by means of a pair of an adjustment screw 92. The drive axle 84 is free to move longitudinally within the confines of a pair of panel slots 94 (FIG. 1) and main frame cut-outs 96 (FIG. 3). An output idle roller 98 is identically mounted at the output end of the ultraviolet dryer 10, with one exception, that is, the pair of adjustable bearing housings 100 are positioned on the outside of the ultraviolet dryer 10 in the opposite direction from those on the input end of the machine. The card transport assembly 18 also incorporates a pair of support rolls 102 that are fixedly attached to a pair of shafts 104. Each shaft of the pair of shafts 104 is rotatably mounted in a pair of bearings 106. The pair of bearings 106 are fixedly attached within the confines of the channel beams 64 and 66 of the main frame 12 as shown in FIG. 6. Again referring to FIG. 3, a belt 108 circumscribes the input drive roller 82 and the output idle roller 98. The lower portion of the belt 108 passes over the pair of support rolls 102 in order that this portion of the belt 108 passes above the collector box assembly 38. The belt 108 is of mesh-type construction as is indicated in FIG. 2. The porous character of the mesh construction permits the cooling air that is delivered from the card cooling duct assembly 36 to pass down, over, and around the freshly printed material being irradiated to pass through the mesh of the belt 108 and be collected within the collector plenum 40. The mesh portion of the belt 108 can be of fiber glass construction (or some other appropriate material) that can withstand the temperatures and irradiation effects produced by the ultraviolet radiator assembly 22.

As can be seen in FIGS. 2 and 3, the upper portion of the belt 108 is supported in a horizontal plane by means of a pair of top roll panels 110 which are fixedly attached between the front channel beam 64 and the rear channel beam 66 and adjacent to the input drive roller 82 and the output idle roller 98. Cooperating with the top roll panels 110 is an adjacent pair of top irradiator panels 112. This particular pair of belt support panels are painted black so as to absorb any ultraviolet radiation that may escape by reflection from the irradiation chamber 20. The pair of top irradiator panels 112 are rigidly affixed between the front channel beam 64 and the rear channel beam 66. As the belt 108 passes under the irradiation chamber 20, it is supported by means of a set of three lateral support rods 114 (see FIGS. 3 and 4). The three lateral support rods 114 are fixedly cradled between a pair of longitudinal angle irons 116 (FIG. 4) that are in turn fixedly attached to interior flanges of the offset center sections 68 of the beams 64 and 66.

The input drive roller 82 is driven in a clockwise direction as shown in FIG. 3 by means of a motor 118, which can be a variable speed motor. The motor 118 is fixedly attached to a pair of longitudinal motor mounting plates 120. The pair of motor mounting plates 120 is rigidly affixed across the top of a pair of lateral support members 122 (FIGS. 3 and 5), that are in turn rigidly affixed to a pair of side panel braces 124. Additional lateral stability of the ultraviolet dryer 10 is provided by a lateral brace 126 (FIG. 3) that is rigidly affixed between the pair of side panel braces 124 at the input end of the ultraviolet dryer 10. The motor 118 drives a pulley 128 that is fitted with a drive belt 130 that encompasses the pulley 128 and a gear box pulley 132 (FIG. 2) of a gear box 134. The gear box 134 is fixedly attached to a pair of lateral support members 122 as can be seen in FIGS. 5 and 2. The gear box 134 comprises an output shaft and sprocket 136 that is fitted with a vertical drive chain 138 (FIGS. 2 and 3) that encompasses the sprocket of the output shaft and sprocket 136 and a drive axle sprocket 140. The drive axle sprocket 140 is rigidly affixed to the drive axle 84. Thus, the motor 118 drives the belt 108 to transfer the cards 19 (FIG. 2) through the irradiation chamber 20.

Irradiation Chamber Assembly

The irradiation chamber 20 as shown in FIGS. 1, 3 and 4 is comprised of a pair of end caps 142 (FIGS. 1 and 3), each constructed from a single sheet of material with all four edges folded over ninety degrees to form partial front, top, back and bottom surfaces, with edge flanges 144 (FIG. 3) being formed on the partial surfaces that cooperate in providing attachment surfaces for related pieces to be described herein. A center section 146 is also constructed of thin sheet material that is folded longitudinally in four places as shown in FIG. 4 to form partial bottom, front, top, and back sides of the irradiation chamber 20. The input and output edges of the center section 146 are folded inward ninety degrees to form end flanges 148 (FIG. 3) that cooperate with the edge flanges 144 during assembly of the irradiation chamber 20. This outer shell assembly of the irradiation chamber 20 is rigidly affixed to the outside surfaces of the offset center sections 68 of the front channel beam 64 and rear channel beam 66 (See FIG. 4). The input and output sides of the irradiation chamber 20 are provided with cut-outs 152 (FIGS. 3 and 4) to permit passage of the belt 108 and the freshly printed materials carried thereupon. Inside surfaces of the outer shell of the irradiation chamber 20 are lined with a heat insulating material 154, such as mineral wool felt or other suitable heat insulating material. A sheet metal liner assembly 156 is inserted within the outer shell of the irradiation chamber 20 and retains the heat insulating material 154. The liner assembly 156 includes a front-half liner 158 (FIG. 4) and incorporates a pair of bottom edge rails 160 (FIG. 3) that facilitate attachment to the input and output sides of the outer shell of the irradiation chamber 20 and communicates with the top portion of the cut-out 152. A backhalf liner 162 (FIG. 4) of the liner assembly 156 is inserted within the outer shell of the irradiation chamber 20 in like manner as the front-half liner 158, as has been previously described. The front-half liner 158 and the back-half liner 162 are fixedly attached to each other along the center longitudinal line or the ultraviolet dryer 10. The irradiation chamber 20 also incorporates a front cut-out access 164 that is finished with an access frame 166. A top panel 168 is positioned in a horizontal plane and fixedly attached to the inside surface of the liner assembly 156, near the top of the irradiation chamber 20. The top panel 168, therefore, forms a bottom wall of the top plenum 28.

Radiation Exhaust and Collector Box Duct Assemblies

The radiation exhaust duct assembly 30 as shown in FIG. 3 is comprised of an irradiation exhaust duct shell 170. The inside surface of the irradiation exhaust duct shell 170 is provided with a thickness of heat insulating material 172. An irradiation exhaust duct liner 174 is provided as a retainer for the heat insulating material 172. The vertical air space within the irradiation exhaust duct liner 174 is separated into two channels by means of a splitter 176 (FIG. 2) that extends fron the top to the bottom of the duct. The irradiator exhaust duct assembly 30 is rigidly affixed to the outside surface of the rear channel beam 66 as well as being rigidly affixed to the input rear side of the irradiation chamber 20, as shown in FIG. 3. A short lateral duct 178 (FIGS. 3 and 5) provide a means of air communication between the top plenum 28 and a first vertical air passage 180. A short discharge duct 182 is provided in the top of an accompanying vertical air passage 184 of the irradiation exhaust duct assembly 30.

Referring to FIG. 4, the collector box assembly 38 incorporates a set of four box tubes 186 rigidly attached in the longitudinal direction to the collector box side panels 56 (FIG. 3). Heat insulation 188 is provided in the recesses between the box tubes 186 and between a front box tube 186A and the collector box bottom ledge 54, and between a back box tube 186B and the collector box back panel 58. A collector box retainer floor 190 is rigidly affixed across the top of the set of four box tubes 186 spaced above the collector box bottom panel 62 as shown in FIGS. 3 and 4. In a similar manner, heat insulation is attached to the inner surfaces of the pair of collector box side panels 56 and to the inside of the collector box back panel 58 (FIG. 4) and is retained in place by a collector box side and back panel liner 192. A short front panel 194 is rigidly affixed to the inner extremity of the collector box top sill 52 and at its edges to the sides of the collector box side and back panel liner 192. A collector box panel 196, that lies in a horizontal plane, is rigidly affixed within the confines of the collector box side and back panel liner 192. The collector box panel 196 divides the collector box assembly 38 into the collector plenum 40 and the accessory cabinet 42, as previously described. A front central post 198 is rigidly affixed to the under side of the collector box top sill 52 and to the top surface of the collector box bottom ledge 54. Access to the collector box accessory cabinet 42 is thereby divided into two separate openings which are closed by a pair of accessory cabinet doors 200 (FIG. 1). FIGS. 3 and 4 show a pair of vent openings 202 that are incorporated in the lower input side of the accessory cabinet 42. Each of the vent openings 202 is finished with a frame assembly 204. Fixedly attached to the outside surface of each frame assembly 204 is a louver panel 206 that provides for the free flow of air into the accessory cabinet 42.

The collector box exhaust system 44 as shown in FIGS. 1, 2 and 3 is comprised of an outer shell 208 that is lined on all vertical surfaces with heat insulation 210 (FIG. 2). The heat insulation 210 is retained in place by a collector box exhaust system liner 212 that extends the full length of the outer shell 208. The top and bottom of the collector box exhaust system 44 are appropriately closed by fixedly attaching thin metal panels to each end, one of which is indicated at 213 in FIG. 3. The collector box exhaust system 44 is rigidly affixed to the outside surface of the rear channel beam 66 (FIG. 6) and to the output rear side of the irradiation chamber 20. Air flows from the collector plenum 40 and the accessory cabinet 42 and passes through the collector box exhaust system 44 as will be described in detail hereinafter. A short exhaust stack 214 is provided within the top wall of the collector box exhaust system 44 and connects to the outside collector box exhaust stack 46 (FIG. 1) and channels contaminated air to the outside ambient air.

Radiator Assembly

Figure 7:
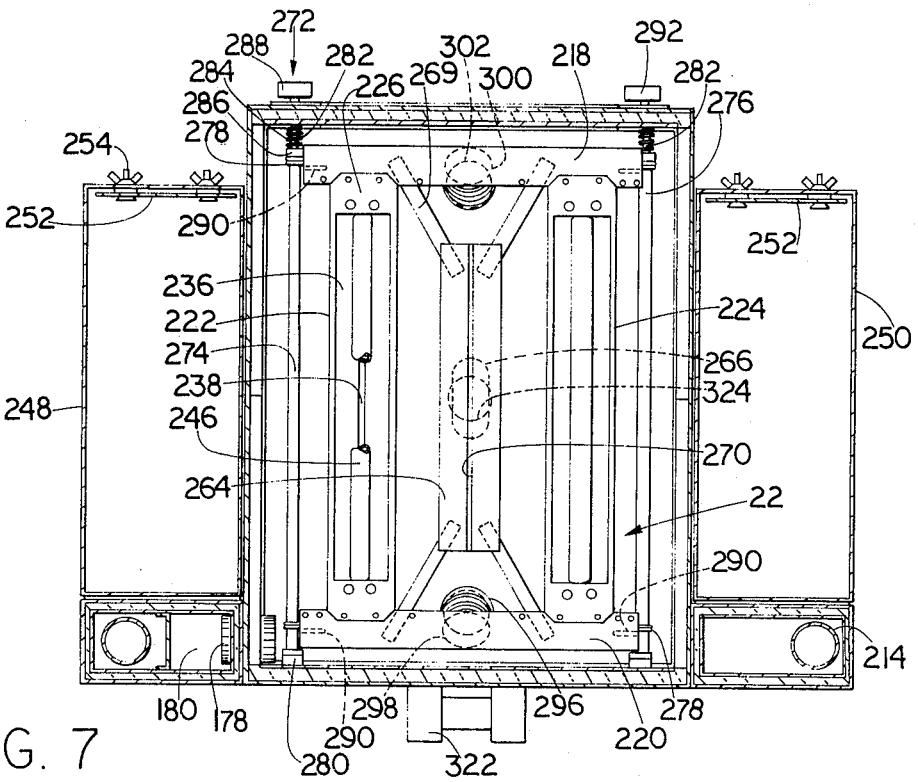
FIG. 7 is a sectional view looking in the direction of the arrows and taken along the line 7—7 in FIG. 1.
Figure 10:
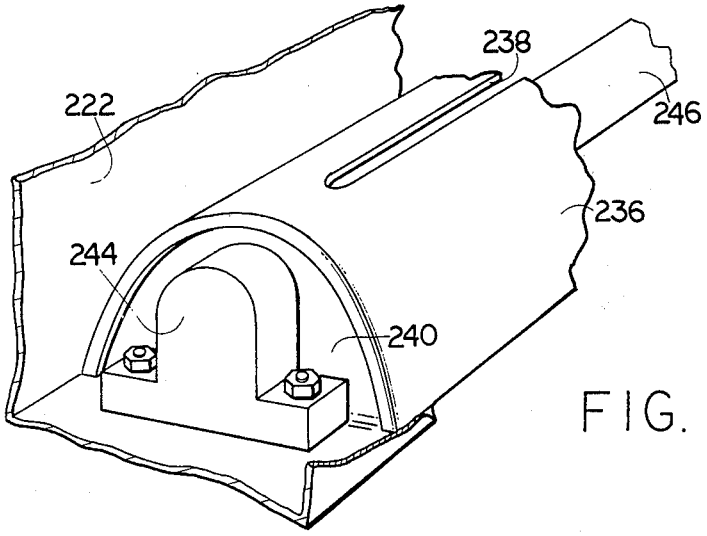
FIG. 10 is a fragmentary perspective view of a lamp housing assembly of a radiator assembly of the machine.
Figure 11:
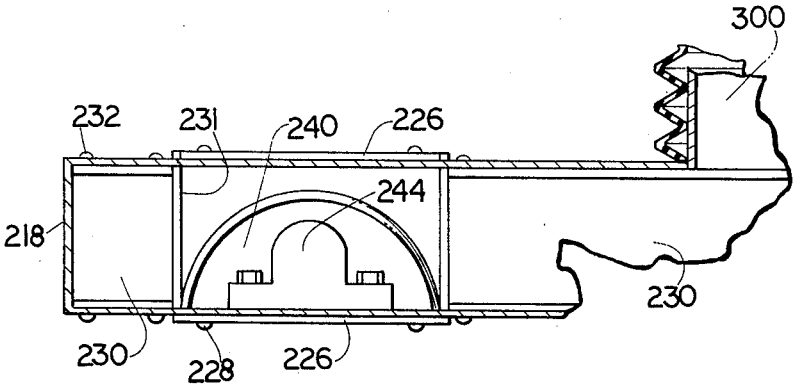
FIG. 11 is a view in section taken on the line 11—11 in FIG. 4A.

The ultraviolet radiator assembly 22 is shown in detail in FIGS. 3, 4, and 7. The ultraviolet radiator assembly 22 incorporates a front longitudinal duct 218 (FIG. 4) and a rear longitudinal duct 220. The ultraviolet radiator assembly 22 also incorporates an input lateral reflector duct 222 and an output lateral reflector duct 224 (FIG. 3). As can be seen in FIG. 7, the front longitudinal duct 218 and the rear longitudinal duct 220 are fixedly attached in a rectangular pattern to the input lateral reflector duct 222 and the output lateral reflector duct 224, by means of flanges 226 (FIG. 4A) incorporated at each end of the input lateral reflector duct 222 and the output lateral reflector duct 224. Sheet metal screws 228 extend through each of the flanges 226 and are threadably held in the upper and lower surfaces of the front longitudinal duct 218 and of the rear longitudinal duct 220. Flow path integrity within the front longitudinal duct 218 and the rear longitudinal duct 220 is maintained by providing the ultraviolet radiation assembly 22 with longitudinal duct inner wall panels 230 (FIGS. 4A and 11). Openings 231, one of which is shown in FIG. 11, between wall panels permit communication between the longitudinal ducts 218 and 220 and the lateral ducts 222 and 224. A plurality of sheet metal screws 232, as shown in FIG. 4A, are provided to mount the longitudinal duct inner wall panels 230. Each of the input lateral reflector duct 222 and the output lateral reflector duct 224 incorporates a bottom panel 236 that is in the form of a concave reflector. Each concave reflector 236 is provided with an air slot 238 (FIG. 10) at the top thereof. The ends of the concave reflectors 236 are closed by partially circular end panels 240 incorporated within the bottom of the lateral reflector ducts 220 and 222. Referring to FIG. 4A, each of the end panels 240 incorporates a hole 242 behind which is fixedly attached an ultraviolet lamp socket 244. An ultraviolet lamp 246 (FIG. 7) is removably mounted in the lamp sockets 244 below the reflector bottom panel 236 of each of the input lateral reflector duct 222 and the output lateral reflector duct 224. The ducts 218, 220, 222 and 224 form a generally rectangular irradiator support frame which supports the lamps 246. The concave reflectors 236 reflect upwardly directly light rays from the lamps 246 downwardly.

Figure 12:
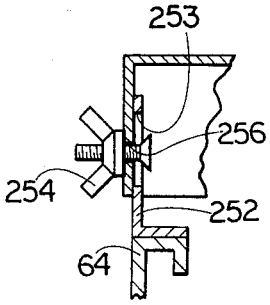
FIG. 12 is a view in section taken on the line 12—12 in FIG. 1.

The irradiated surfaces of the articles 19 (FIG. 2) can reflect some of the ultraviolet radiation away from themselves in a multitude of directions thereby producing some randomly directed light that could escape the irradiation chamber 20 through the cutouts 152 (FIG. 3) provided in the input and output walls of the irradiation chamber 20. Therefore, an input radiation shield 248 and an output radiation shield 250 are provided to trap erring light from escaping the confines of the ultraviolet dryer 10. The input radiation shield 248 and the output radiation shield 250 are identical in construction and are vertically adjustable above the card transport assembly 18. A pair of front frame mounting brackets 252 (FIG. 5) is rigidly affixed to the top surface of the front channel beam 64 and each incorporates a pair of slots 253, one of which is shown in FIG. 12, through which a pair of wingnut and bolt assemblies 254 are fitted, as shown in FIGS. 1, 5 and 7. The front surface of each of the radiation shields 248 and 250 is provided with a pair of holes 256, one of which is shown in FIG. 12. Each hole 256 cooperates with one of the wingnut and bolt assemblies 254 to provide vertical adjusting means for the input radiation shield 248 (FIG. 1) and the output radiation shield 250. In similar manner, a pair of duct mounting brackets 258 is rigidly affixed to the top surfaces of the input radiation shield 248 and the output radiation shield 250. Each of the pair of duct mounting brackets 258 is provided with a pair of slots 260, each incorporating a wingnut and belt assembly 262 that passes through an associated one of the slots 260. The bolts of the assemblies 262 are mounted on front panels of the radiator cooling system 24 and of the collector box exhaust system 44. In this manner, the input radiation shield 248 and the output radiation shield 250 can be vertically adjusted, the effectiveness of the input radiation shield 248 and the output radiation shield 250 can be maximized by minimizing the vertical distance between the lower edges of the shields and irradiated materials 19 (FIG. 2) being moved along the card transport assembly 18.

The ultraviolet radiator assembly 22 is associated with the card cooling duct assembly 36 (FIG. 3). The card cooling duct assembly 36 includes a lateral cooling air plenum 264, a short vertical duct 266 (FIG. 4) and a flexible duct extension 268. The lateral cooling air plenum 264 is fixedly suspended between the front longitudinal duct 218 and the rear longitudinal duct 220 as shown in FIGS. 4 and 7 by a set of four support members 269. Ends of the plenum 264 are closed by plates 271 (FIG. 4). As air enters the lateral cooling air plenum 264 (FIG. 4) from the flexible duct extension 268 to the short vertical duct 266, it spreads laterally and is discharged downwardly through a thin nozzle or slot 270 to form a thin curtain of air that passes downwardly and spreads longitudinally across the irradiated materials being moved along by the card transport assembly 18, thereby controlling their temperature and forcefully holding down their edges so that the irradiated product is not deformed. The nozzle or slot 270 overlies and extends substantially the width of the conveyor belt 108. Air is supplied to the lateral cooling plenum 264 through the top lateral plenum 34 and a vertical pressure stack 324. A blower 322 forces air into the top lateral plenum 34.

The ultraviolet radiator assembly 22 is supported by a vertical suspension and adjustment system 272 as shown in FIGS. 3 and 4. The vertical suspension and adjustment system 272 is comprised of an input adjustment rod 274, an output adjustment rod 276 (FIG. 3) and a set of four suspension cables 278. The input adjustment rod 274 is rotatably mounted on the rear wall of the irradiation chamber 20 by means of a bearing 280 (FIG. 4). A front portion of the input adjustment rod 274 incorporates a smaller diameter section 282 tht extends through a clear hole 283 (FIG. 4C) that is located in the front wall of the irradiation chamber 20. The rod 274 is maintained in the bearing 280 by means of a compression spring 284 (FIG. 4) which bears against a collar 2861 that is rigidly affixed at the inner end of the smaller diameter section 282 of the input adjustment rod 274. The external extremity of the smaller diameter section 282 carries an adjustment and locking knob 288 as can be seen in FIG. 4. A locking plate 285, shown in FIGS. 4B and 4C, functions as a sleeve bearing for the small diameter section 282 and is fixedly attached to the front wall of the radiation chamber 20 by a set of 3 screws 286 that extend through a set of 3 clear holes 287 (FIG. 4C) in the plate 285 and threadably fasten in the front face of the irradiation chamber 20. The small diameter section 282 extends through and is guided by a central bore 2282 (FIG. 4B) in the locking plate 285. The locking plate 285 incorporates a set of 8 holes 289 equally spaced circumferentially about the axis of the central bore 2282. The adjusting and locking knob 288 is shown in detail in FIGS. 4D and 4E. The adjusting and locking knob 288 is attached to the small diameter section 282 by means of a set screw 290 (FIG. 4D) that is threadably mounted in a threaded bore 291 of the adjusting and locking knob 288. Slidably mounted in a smooth bore 293 (FIG. 4E) is a cylindrical latch 295 that incorporates a hemispherical locking lobe 297 at its end. The cylindrical latch 295 is placed in the smooth bore 293 on top of a compression spring 299 that loads the hemispherical locking lobe 297 of the cylindrical latch 295 against any one of the set of 8 holes 289 of the locking plate 285 when in assembly. As the adjusting and locking knob 288 is turned, the applied torque forcefully backs the cylindrical latch 295 out of restraint with any one hole of the set of 8 holes 289. This provides that the adjustment rod 274 can be locked in any desired position. Similarly, a locking knob 292 (FIG. 1) mounted on the adjustment rod 276 can cooperate with a locking plate 2285 for locking the adjustment rod 276 in selected position. The output adjustment rod 276 is installed within the irradiation chamber 20 in an identical manner to the input adjustment rod 274 with one exception, that is, the output adjustment rod 276 is arranged to be rotated clockwise to obtain vertically upward adjustments and the input adjustment rod 274 is rotated counterclockwise to obtain vertically upward adjustment. A pair of the set of four suspension cables 278 is fixedly attached to each of the input adjustment rod 274 and the output adjustment rod 276. The bottom extremities of the set of four suspension cables 278 are fixedly attached to a set of four suspension rings 290, two of which are shown in FIG. 3. The set of four suspension rings 290 are fixedly attached approximate to the input and output ends of the front longitudinal duct 218 and the rear longitudinal duct 220. Since the ultraviolet radiator assembly 22 is suspended in this manner, counterclockwise rotation of the adjusting and locking knob 288 (FIG. 1) raises the input end of the ultraviolet radiator assembly 22, thus providing a means for controlling the intensity of radiation that is initially delivered to the freshly printed matter moving along the card transport assembly 18. In similar manner, rotation of the adjustment and locking knob 292 in clockwise direction, raises the output end of the ultraviolet radiator assembly 22 to control the intensity of radiation at the output end of the ultraviolet radiator assembly 22. Manipulation of the adjusting and locking knobs 288 and 292 in unison can cause raising and lowering of the radiator assembly 22 as a unit while maintaining a horizontal disposition or a selected sloping disposition.

Radiator Cooling Assembly

Operation of the radiator cooling system 24 will now be described with reference to FIGS. 2, 3, 4, and 7. Ambient air is drawn vertically downward through a rear down draft tube 294 (FIG. 4) that extends through the top lateral plenum 34, through the top wall of the irradiation chamber 20, through the top plenum 28 and through the top panel 168 to terminate within the irradiation chamber 20. The lower end of the rear down draft tube 294 is extended vertically downward by means of a flexible down draft tube 296 and connects to a down draft nipple 298 that is an integral part of the rear longitudinal duct 220. As air is drawn vertically downward through the flexible down draft tube 296 and the down draft nipple 298, it flows longitudinally in both directions through the rear longitudinal duct 220 (see FIG. 7). The air is then drawn laterally into the input lateral reflector duct 222 and the output lateral reflector duct 224. (FIG. 3) The low pressure maintained within the input lateral reflector duct 222 and the output lateral reflector duct 224 also induces air to enter the duct system through the air slots 238 of the concave reflectors 236, thereby providing a measure of cooling air to flow around the ultraviolet lamps 246. The air being drawn through the input lateral reflector duct 222 and the output lateral reflector duct 224 subsequently is drawn into the front longitudinal duct 218 and is collected into a single air stream within the vertical draft nipple 300 (FIG. 4). The vertical draft nipple 300 is an integral part of the front longitudinal duct 218. The vertical draft nipple 300 communicates with a vertical draft flexible tube 302. The vertical draft flexible tube 302 is fixedly attached to a vertical draft exhaust nipple 304 that is rigidly affixed through the top panel 168 and approximate to the front of the irradiation chamber 20. The ultraviolet radiator assembly cooling air is thereby drawn into the top plenum 28. Air is drawn out of the top plenum 28 through the short lateral duct 178 that communicates with the vertical air passage 180 as previously described. The air passes downwardly through the vertical air passage 180 and into an inlet blower duct 306 as is shown in FIGS. 2, 3 and 5. The air is then drawn into an irradiation chamber exhaust blower 308 that imparts an increase in pressure to the air thus forcing it through a blower exhaust duct 310 (FIGS. 2 and 3) and into the accompanying vertical air passage 184 (FIG. 3). The air is then forced upward and through the short duct 182. An irradiator exhaust stack 312 (FIG. 1) can receive air from the short duct 182 and discharges the hot and contaminated air to the outside ambient environment. The irradiation chamber exhaust blower 308 is driven by an irradiator exhaust duct motor 314 (FIG. 3). The irradiator exhaust duct motor 314 is fixedly attached to a mounting bracket 316 that is in turn fixedly attached to a pair of longitudinal mounting beams 318. The pair of longitudinal mounting beams 318 is rigidly affixed at their ends to a pair of lateral mounting beams 320 that are rigidly affixed at their ends to the side flanges of the appropriate side panels of the set of eight side panels 14.

Card Cooling System

As already pointed out, the card cooling duct assembly 36 is supplied with ambient air by means of the blower 322, as shown in FIGS. 4 and 7. The blower 322 forces air into the top lateral plenum 34 (FIG. 4). Air exits the top lateral plenum 34 through the vertical pressure stack 324 located through the center of the top of the chamber 20. The vertical pressure stack 324 extends downwardly through the top plenum 28 and also through the top panel 168 to terminate slightly below the top panel 168. The lower portion of the vertical pressure stack 324 communicates with the flexible duct extension 268. The duct extension 268 is attached at its lower end to the short vertical duct 266 that is an integral part of the lateral cooling air plenum 264. Air is directed laterally in both directions in the cooling air plenum 264. As has been previously described, the air exits through the thin nozzle 270 to flush downwardly and over the irradiated material being moved along the card transport assembly 18. Flushing the irradiated surfaces with cooling air fulfills two objectives. First, it minimizes the temperature rise induced in the irradiated surfaces or materials, and thereby minimizes the risk of discoloration or scorching. Secondly, the cooling air helps to pin the irradiated surfaces to the belt 108 and physically restrains the irradiated surfaces from deforming until the temperature gradients can be returned to normal.

Figure 9:
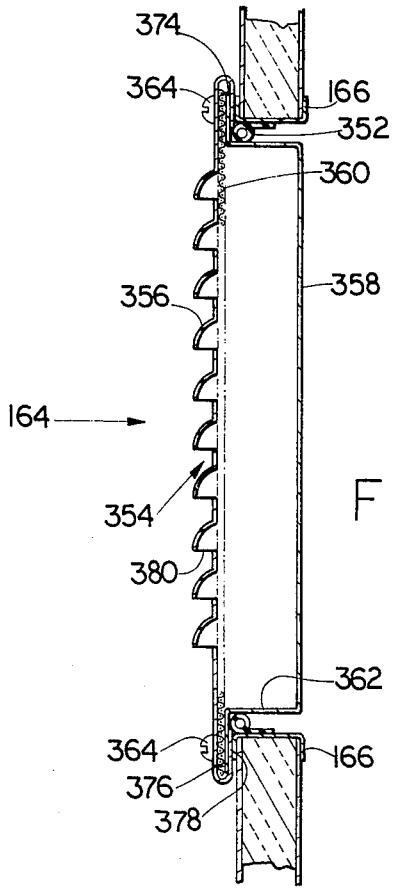
FIG. 9 is a fragmentary view in section taken on the line 9—9 in FIG. 1 showing a closure panel that covers an access opening to the irradiation chamber of the ultraviolet dryer machine.

The collector box assembly 38 (FIG. 3) is comprised of the collector plenum 40 and the accessory cabinet 42 as has been previously described. The collector plenum 40 collects air from various openings throughout the radiation chamber 20. More specifically, as air is blown into the irradiation chamber 20 by means of the thin nozzle 270, it passes down over the irradiated surfaces and through the belt 108 and is induced to flow into the collector plenum 40. The collector plenum 40 also induces air to flow inwardly through the cut-outs 152 at the input and output side of the irradiation chamber 20. As will be described hereinafter, some additional air is also induced to flow through the front cut-out access 164 (FIGS. 4 and 9). As the air from these multiple sources is collected within the collector plenum 40 (FIG. 3), the air is drawn into an inlet duct 326 (FIGS. 3 and 6) of a collector plenum exhaust blower 328 where it is pressurized and exhausted through an exhaust blower duct 330. The inlet duct 326 draws air from both the collector plenum 40 and the accessory cabinet 42. Air is driven from the exhaust blower duct 330 into a collector box exhaust stack 332. The air is driven up and through the short exhaust stack 214 and through the outside collector box exhaust stack 46 (FIG. 1) so that the contaminated hot air is delivered to the outside ambient environment. The collector box exhaust blower 328 (FIG. 3) is driven by an exhaust blower motor 334 that is fixedly attached to a motor mount 336. The motor mount 336 is rigidly affixed to a pair of longitudinal mounting beams 338 that are rigidly affixed at their ends to a pair of lateral mounting beams 340. The pair of lateral mounting beams 340 are rigidly affixed at their ends to the side flanges 74 of the appropriate pair of side panels of the set of eight side panels 14.

Figure 8:
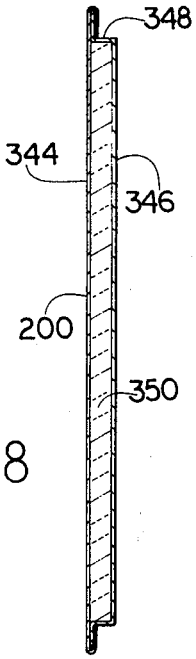
FIG. 8 is a partial sectional view taken along the line 8—8 in FIG. 1 of a door which closes an accessory cabinet of the ultraviolet dryer machine.

The pair of accessory cabinet doors 200 are shown in front elevation in FIG. 1 and one of the doors 200 is shown in section in FIG. 8. The pair of accessory cabinet doors 200 are constructed to perform as a heat barrier as well as to cooperate in closing the front of the accessory cabinet 42 and the collector plenum 40. The pair of accessory cabinet doors 200 are hinged to the pair of collector box side panels 56 (FIG. 4) by means of a pair of piano hinges 342 (FIG. 1). When the pair of accessory cabinet doors 200 is closed, the collector box exhaust blower 328 induces air to enter the accessory cabinet 42 (FIG. 3) by way of the pair of louver panels 206. The pair of louver panels 206 perform as an air metering device to restrict the amount of air that passes into the accessory cabinet 42. The air thus introduced into the accessory cabinet 42 circulates around devices 421 contained in the accessory cabinet 42, which can be electrical devices, not shown in detail, for powering the lamps 246, and is drawn from the cabinet 42 by the collector box exhaust blower 328 through the lower half of the inlet duct 326 as shown in FIGS. 3 and 6. One of the accessory cabinet doors 200 is shown in section in FIG. 8. The accessory cabinet door is comprised of an external panel 344 and an internal panel 346. The internal panel 346 is constructed with flanged edges 348 on all four sides. The volume defined between the external panel 344 and the internal panel 346 is filled with a heat insulating material 350.

As shown in FIG. 9, the front cut-out access 164 is finished with the access frame 166 as has been previously described. A flexible seal 352 is fixedly attached upon the access frame 166 and circumscribes the front cut-out access opening 164. A front access panel 354 is comprised of an external louver panel 356, and an internal light shield 358. The light shield 358 is generally channel shaped and includes upper and lower horizontal sections 362 which terminate in upwardly and downwardly directed flanges 374 and 376. Flanges 378 on the louver panel 356 cooperate with the flanges 374 and 376 to hold a screen wire insect barrier 360 which covers louver openings 380 on the louver panel 356. Air is drawn through the openings 380 in the external louver panel 356 and the screen wire insect barrier 360 and into the volume between the external louver panel 356 and the internal light shield 358. The air then travels longitudinally and exits the front access panel 354 along its vertical edges thereby passing into the interior portions of the irradiation chamber 20. The internal light shield 358 does not prevent air from entering the irradiation chamber 20, but does prevent random ultraviolet radiation from escaping the irradiation chamber 20 by means of the external louver panel 356. The front access panel 354 is removably held in place by a set of four bolts 364 that pass through the edges of the front access panel 354 and are threadably mounted in the access frame 166.

The machine illustrated in the drawings and described above is subject to structural modification without departing from the spirit and scope of the appended claims.

What is claimed is:

1. In a machine for irradiating articles, the combination of an irradiation chamber, a conveyor having a course extending beneath the irradiation chamber for conveying the articles beneath the irradiation chamber, an irradiator support frame in the irradiation chamber above the conveyor, a plurality of irradiation lamps mounted on the irradiator support frame spaced along the irradiator support frame in the direction of conveyor movement, means for mounting the irradiator support frame for raising and lowering to control the distance between the lamps and the articles on the conveyor, the means for mounting the irradiator support frame including independent end support means at an input end and at an output end, means for raising and lowering the end support means at the input end and at the output end independently for controlling the slope of the irradiator support frame so that the intensity of irradiation is varied along the path of conveyor movement, and means mounted on the irradiator support frame for directing air against the articles on the conveyor to hold the articles on the conveyor and to cool the articles.

2. A machine as in claim 1 wherein the means for mounting the irradiator support frame includes cable means attached to corners of the irradiator support frame, transverse cable supporting shafts rotatably mounted above the irradiator support frame, the cable means being attached to the cable supporting shafts, and means for turning the cable supporting shafts for raising and lowering the input end and the output end of the irradiator support frame.

3. A machine as in claim 1 wherein the means for directing air against the articles includes a cooling air plenum supported on the irradiator support frame, the cooling air plenum has a downwardly directed nozzle, and there is means for directing air under pressure into the cooling air plenum to be discharged through the nozzle against the articles on the conveyor.

4. A machine as in claim 3 wherein the nozzle extends transversely of the direction of conveyor advance for substantially the width of the conveyor so that a curtain of air is directed against the conveyor.

5. A machine as in claim 3 wherein the conveyor is porous so that the air can pass through the conveyor around the articles to hold the articles firmly on the conveyor.

6. A machine as in claim 1 wherein there is a collector plenum chamber beneath the irradiation chamber and the conveyor, the conveyor is porous, and there is means for withdrawing air from the collector plenum chamber.

7. A machine as in claim 1 wherein the irradiator support frame includes spaced longitudinal ducts and lateral reflector ducts connecting the longitudinal ducts, lower walls of the lateral ducts overlie the lamps, there is means for withdrawing air from one of the longitudinal ducts and means for permitting air to enter the other longitudinal duct, and there are openings in the lower walls of the lateral ducts, there being reduced pressure in the lateral ducts and said one of the longitudinal ducts so that air from around the lamps enters the lateral ducts to be discharged through said one of the longitudinal ducts.

8. A machine as in claim 1 wherein the lamps are elongated and extend transversely of the direction of conveyor advance and the air directing means has an opening extending transversely of the direction of conveyor advance and is disposed between the lamps.

9. In a machine for irradiating articles, the combination of an irradiation chamber, a conveyor having a course extending beneath the irradiation chamber for carrying the articles beneath the irradiation chamber, an irradiator support frame in the irradiation chamber above the conveyor, the irradiator support frame including spaced longitudinal ducts and spaced lateral reflector ducts connecting the longitudinal ducts, an elongated irradiation lamp underlying a lower wall of each reflector duct, there being an elongated opening in the lower wall of each reflector duct overlying the lamp associated therewith, means for mounting the irradiator support frame for raising and lowering to control the distance between the lamps and the articles on the conveyor, a cooling air plenum supported on the irradiator support frame between the reflector ducts, the cooling air plenum having an elongated nozzle extending transversely of the direction of conveyor advance for substantially the width of the conveyor, means for directing air under pressure into the cooling air plenum to be discharged against the articles on the conveyor, and means for withdrawing air from one of the longitudinal ducts to draw air around the lamps and through the openings in the reflector ducts.

10. A machine as in claim 9 wherein there is a collector air plenum chamber beneath the irradiation chamber and the conveyor, the conveyor is porous, and there is means for withdrawing air from the collector plenum chamber.

* * * * *